US005099673A

United States Patent [19]

Baur

[11] Patent Number: 5,099,673

[45] Date of Patent: Mar. 31, 1992

[54] DRAWING APPARATUS IN DRAWING STAGES OF PRESSES

[75] Inventor: Siegfried Baur, Göppingen, Fed. Rep. of Germany

[73] Assignee: L. Schuler Pressen GmbH, Fed. Rep. of Germany

[21] Appl. No.: 597,798

[22] Filed: Oct. 10, 1990

[30] Foreign Application Priority Data

Oct. 10, 1989 [DE] Fed. Rep. of Germany ..... 3933806

[51] Int. Cl.[5] ..... B21D 24/14

[52] U.S. Cl. ..... 72/351; 267/119

[58] Field of Search ..... 72/345, 351, 453.13; 267/119

[56] References Cited

U.S. PATENT DOCUMENTS

| | | | |
|---|---|---|---|
| 1,742,877 | 1/1930 | Rode et al. | 267/119 |
| 2,233,164 | 2/1941 | Glasner | 267/119 |
| 4,601,190 | 7/1986 | Schneider et al. . | |
| 4,712,412 | 12/1987 | Roos et al. . | |
| 4,821,552 | 4/1989 | Baur et al. | 72/351 |

FOREIGN PATENT DOCUMENTS

| | | |
|---|---|---|
| 0173755 | 6/1984 | European Pat. Off. . |
| 2806528 | 12/1979 | Fed. Rep. of Germany . |
| 3505984 | 8/1986 | Fed. Rep. of Germany . |
| 3807683 | 9/1989 | Fed. Rep. of Germany . |

*Primary Examiner*—Lowell A. Larson

*Attorney, Agent, or Firm*—Evenson, Wands, Edwards, Lenahan & McKeown

[57] ABSTRACT

A drawing apparatus in drawing stages of a press, having a pressure cheek divided into segments, to the corner areas of which pressure cylinders are applied. The pressure cylinders are fixed to the press. Their piston rods, by way of pressure rods, act upon a liftable and lowerable console. At least one locking cylinder which is fixed to the frame is provided which, by way of a lift bridge, is applied to the console and, corresponding to the pressure which acts upon it, prevents an upward movement of the console and thus of the pressure cheek. The point in time of the stop stage in the upward-moving stage can be determined by the valve control of the pressure in the locking cylinders.

3 Claims, 4 Drawing Sheets

DRAWING APPARATUS IN DRAWING STAGES OF PRESSES

BACKGROUND AND SUMMARY OF THE INVENTION

The invention relates to drawing apparatus in presses, having a pressure cheek for holding the metal sheet during the drawing operation, separately adjustable pressure cylinders which, by way of the pressure cheek, act upon metal-sheet holders in the tools locking cylinders for a controlled raising of the metal-sheet holder after the drawing operation.

Drawing devices are used for generating metal-sheet holding forces during the deformation (drawing) and during the ejector movement (raising) of the drawn part from the tool of a press. During the drawing operation, the metal-sheet holding forces or counterholding forces are applied by pressure cylinders the pressure of which can be individually adapted to the drawing requirements, which are designed for the avoidance of cracks and folding. The ejector movement for the raising of the formed drawn part is controlled by means of locking cylinders.

From European patent document EP 0173 755 A1, it is known to adapt the metal-sheet holding forces in the various contact pressure ranges before and after the deformation. On the basis of the German patent document DE 35 05 984 A1, it is known, in the case of a drawing apparatus, to control the ejector movement of the metal-sheet holder in a time-delayed manner to the upward movement of the slide and the speed of the ejector movement. Additional control measures for metal-sheet holder are disclosed in German patent document DE 38 07 683 A1. Thus, for example, the movement and the stop of a pressure cylinder piston is used for limiting the movement of the piston of another pressure cylinder, in this case, of a drawing cylinder. In addition, this text shows a divided pressure cheek the segments of which can individually be acted upon by pressure.

German patent document DE 28 06 528 B 2, discloses a device for the mechanical height adjustment of four pressure points of a metal-sheet holding device. However, the object according to the invention is not achieved by this measure in the case of drawing apparatus of this type.

It is an object of the invention to interrupt the ejector movement of the pressure cylinders in a preselected position, for example, after 10 mm, and to resume the raising movement for the pressure cheek at a later time-delayed moment. In this case, the starting position for the beginning of the drawing must be controllable, and the lower dead center for the drawing apparatus must be adjustable to the tool requirements.

In a drawing apparatus of the above-mentioned type, this object is achieved in that each of the segments of the pressure cheek, in a sensitive manner, can be adjusted to the requirements of the drawing in partial areas of the drawn part. The console, which is common to all piston rods and all pressure rods, permits a joint control of the upward movement of all pressure rods. The valve control permits a precise maintaining of the predetermined detent point of the ejector movement.

Other objects, advantages and novel features of the present invention will become apparent from the following detailed description of the invention when considered in conjunction with the accompanying drawings.

DETAILED DESCRIPTION OF THE DRAWINGS

Figure 1:
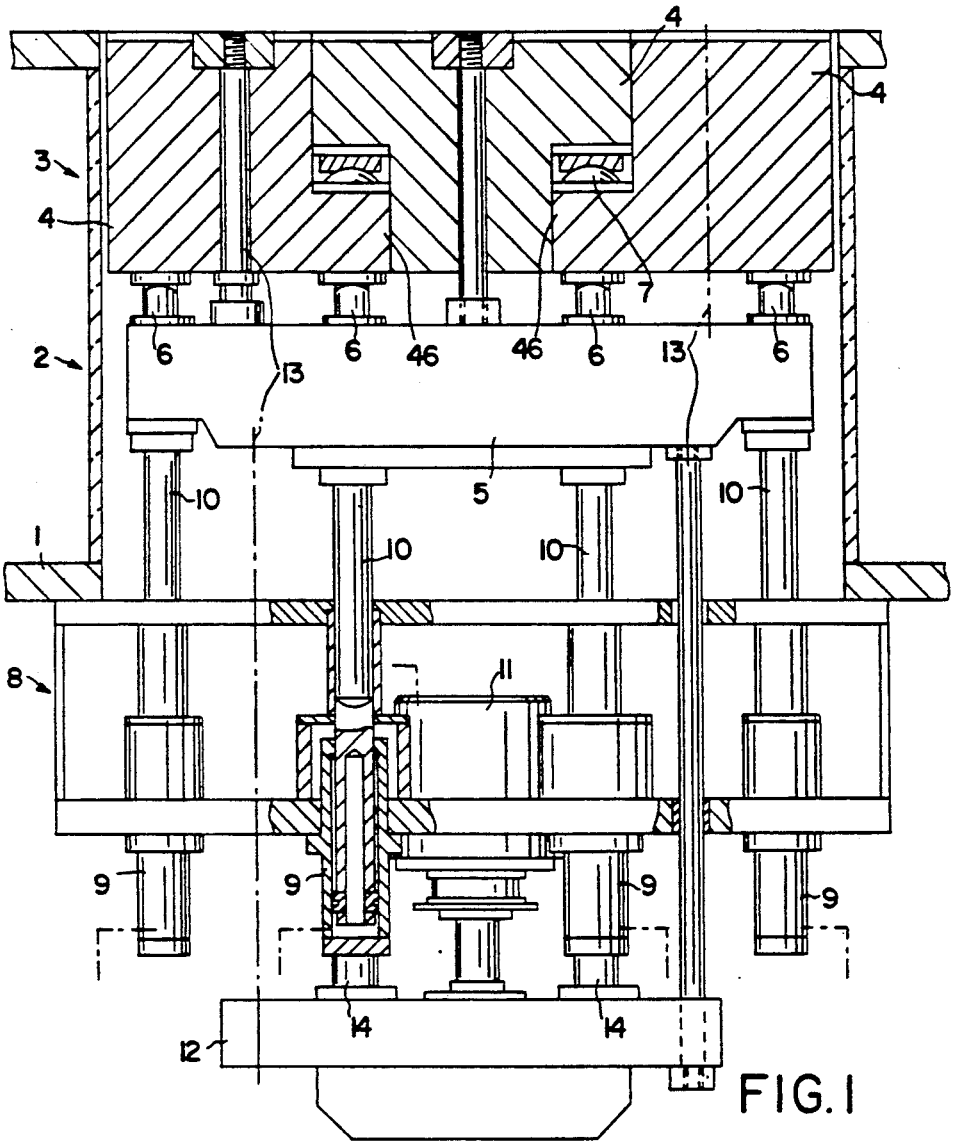
FIG. 1 is a partial sectional view of a drawing apparatus according to the invention.

Referring to FIG. 1, the pressure cheek 3 comprises segments 4 and is disposed in the press bed 1 in a liftable and lowerable manner. In FIGS. 6*a*–6*d* illustrating the operation of the press, the pressure cheek is indicated by reference numeral 52. The segments 4 are connected with one another by means of ball-and-socket joints or similar joints 7. For this purpose, stops 46 are provided which reach under one another. The drawing apparatus which, as a whole, has the reference number 2 has a cylinder bridge 8 which is fixed in the press bed 1. Drawing cylinders 9, a pre-acceleration cylinder 11 and locking cylinders 14 are arranged on the cylinder bridge 8. The drawing cylinders 9, by way of pressure rods 10 in the extension of the piston rods, are applied from below to a console 5. By way of pressure rods with ball-and-socket joints or similar joints 6, the console 5 is applied to the segments. The console 5 can be lifted and lowered by means of the movement of the pressure rods 10 and can be locked in the upward movement by the locking cylinders 14 and their piston rods. For this purpose, the locking cylinders 14 cooperate with a lift bridge 12. By means of clamping bolts 13, this lift bridge 12 forms an assembly together with the console 5 and the segments 4 which permits a mutual movement of the segments 4 with respect to one another essentially in the pressure direction of the segments 4.

Figure 2:
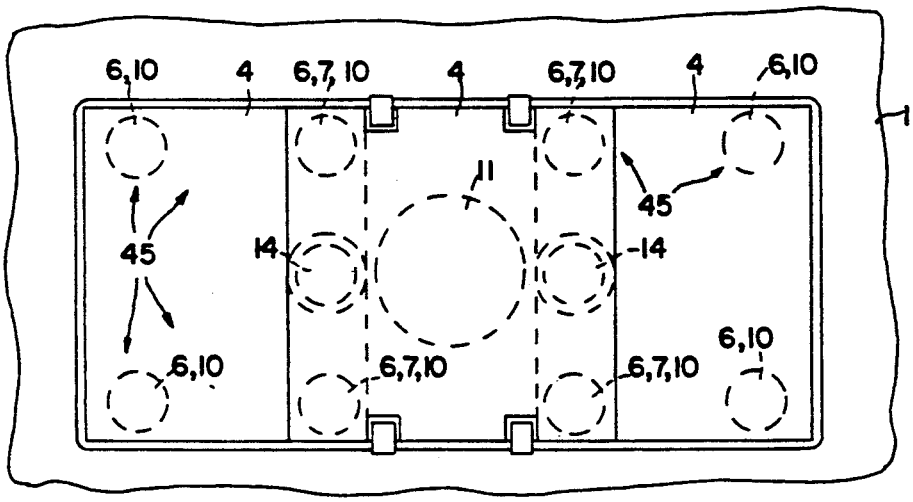
FIG. 2 is a view of the divided pressure cheek in the drawing apparatus according to FIG. 1.

FIG. 2 shows the application of the pressure rods 10 acted upon by the drawing cylinders 9, by way of ball-and-socket joints or similar joints 6, in the corner areas 45 of the segments 4. The locking cylinders 14 are applied in the center with respect to the console 5 and on both sides with respect to the pre-acceleration cylinder 11. The pre-acceleration cylinder 11 acts upon the lift bridge 12 in the drawing direction and thus causes a downward movement of the segments 4 and of the metal-sheet holder in the tool shortly before the top part of the tool impacts on the drawn part.

Figure 3:
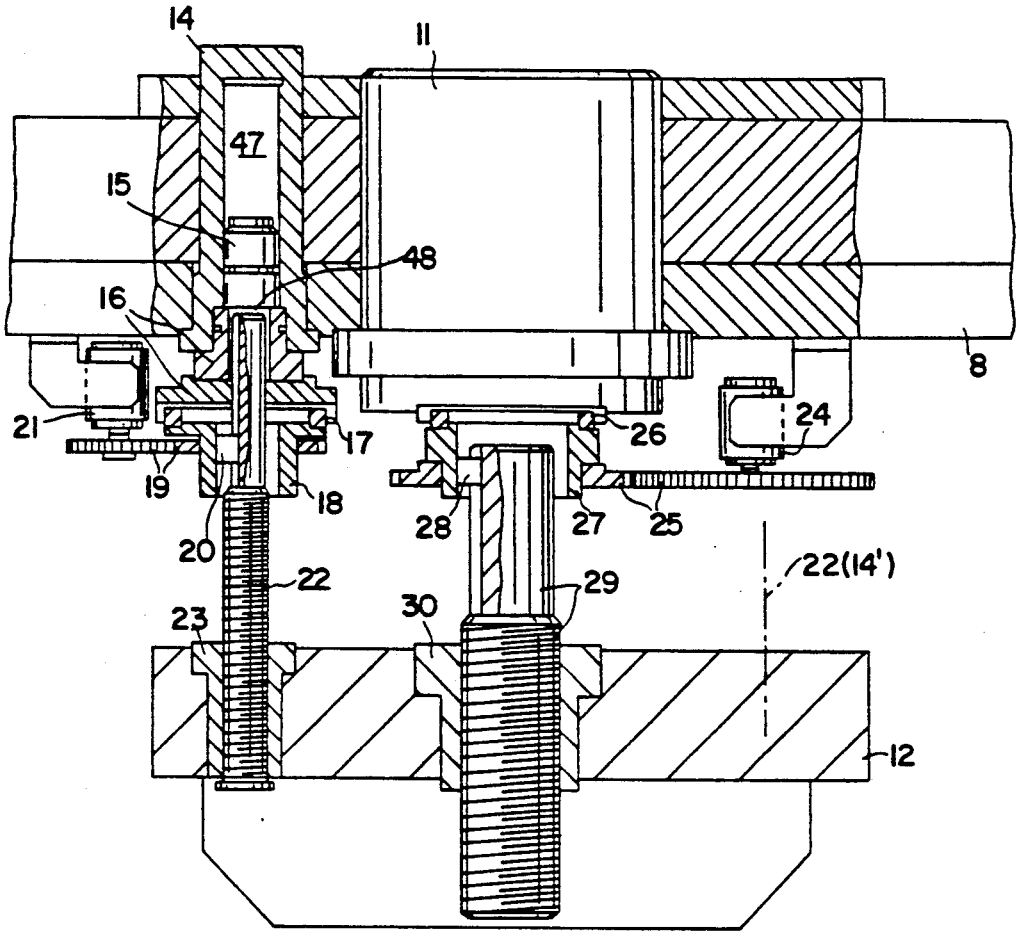
FIG. 3 is a cut-out from FIG. 1 with the locking arrangement and the stroke adjustment.

FIG. 3, depicts cylinder bridge 8 and the lift bridge 12, and shows the special arrangement of the pre-acceleration cylinder 11 and one of, for example, two locking cylinders 14. (The second locking cylinder has the reference number 14'.) The locking cylinders 14 have a pressure space 47 (FIG. 5) which is closed off in the downward direction by means of a piston 15. A spindle 22 can be guided against the piston 15 from below which, in a threaded bush 23 disposed in the lift bridge 12, can be unscrewed from this lift bridge in the upward direction and can be screwed into this lift bridge 12 in the downward direction. The distance 48 which can be adjusted between the spindle 22 and the piston 15 by means of the adjustment of the spindle 22 determines the point in time at which the upward movement of the drawing apparatus is interrupted (36 in FIG. 4). The upper part of the spindle interacts with a hub 18 by way of a longitudinal-groove feather connection 20. The hub 18 is rotatably disposed in a bearing on the piston insert 16. The hub 18 and thus the threaded spindle 22, by way of a gear pairing 19, are in rotating connection with an adjusting device 21.

In the same manner, the piston of the pre-acceleration cylinder 11, together with a threaded spindle 29 which is rotatably disposed in a threaded bush in the center with respect to the lift bridge 12, forms an earlier or later driving medium for the lift bridge 12 when the pre-acceleration cylinder 11 is acted upon. The spindle 29, by way of a longitudinal-groove feather connection 28 in its upper part, is in rotating connection with a hub 27 disposed in a bearing 26 at the pre-acceleration cylinder 11 and by way of a gear wheel pairing 25, is in rotating connection with an adjusting device 24.

Figure 4:
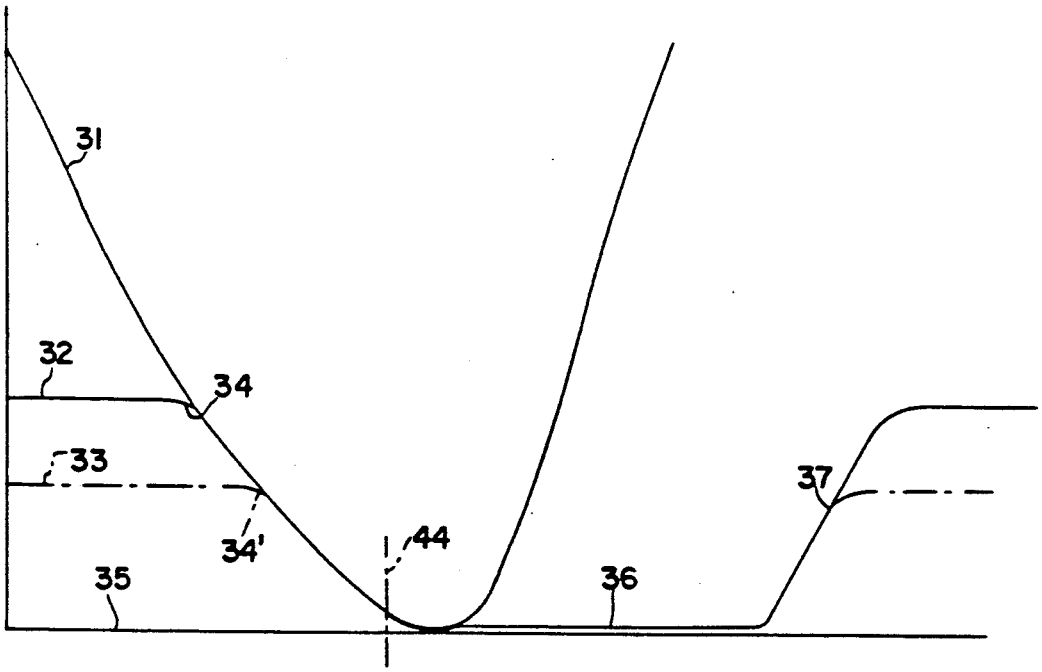
FIG. 4 is a diagram of the movements of the slide and of the drawing apparatus.

The diagram in FIG. 4, by means of the curve 31, shows the sequence of movements of the slide—stroke over time or the rotating angle—. Reference number 35 indicates the lower dead center of the movement of the slide of the press which is also the lower dead center of the drawing apparatus in this diagram. Although corresponding to the tool dimensions (measurements of height) and the use of pressure bolts with different lengths between the segments 4 and the metal-sheet holder or the metal-sheet holders in a tool placed on the press bed 1, the lower dead center of the drawing apparatus is reached at the same time as the dead center of the slide, the height of the dead center position may vary. Reference number 32 indicates a high position of the pressure cheek 3 or its segments 4 (52 in FIGS. 6*a*–6*d*). The actuation of pre-acceleration cylinder 11 causes a lowering of the segments 4 in the area 34 before the upper part of the tool impacts on the drawn part. The unscrewing of the spindle 29 from the lift bridge 12 in the upward direction in FIG. 3 results in a high position which was indicated, for example, by position 33 in FIG. 4. Reference number 34', in turn, indicates the pre-acceleration of the segments 4. In order to interrupt the drawing apparatus with the segments 4 in the upward movement 37, the valves 38 and 39 shown in FIG. 5 must be acted upon correspondingly. Reference number 36 indicates a stop stage of the drawing apparatus in order to remove the drawn part from the tool after it had been lifted out of the mold of the tool.

Figure 5:
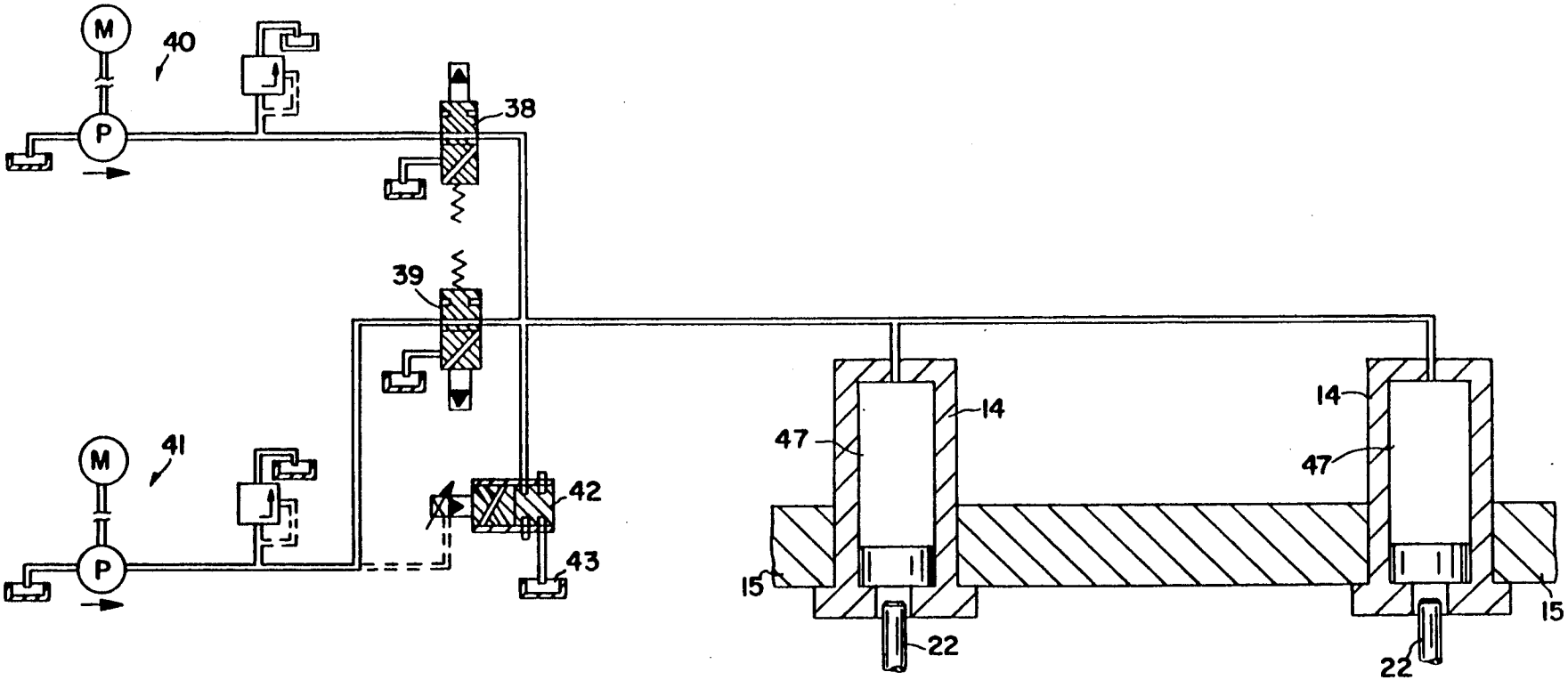
FIG. 5 is a hydraulic circuit for the locking cylinders.

In the drawing stage, the valve 38 shown in FIG. 5 is switched open. As a result, the pressure spaces 47 of the locking cylinder 14 are connected with a low-pressure source 40. Consequently, the pressure space 47 which is reduced in the upward-moving stage 37, fills up with hydraulic oil. In order to now cause the stop stage 36 of the drawing apparatus, valve 39 must be opened at a point in time which is indicated by reference number 44 in FIG. 4. As a result, the pressure spaces 47 of the locking cylinders 14 are connected with a high-pressure source 41. Additional devices, which are known per se with respect to their use, which is to maintain pressure constancy and to avoid pressure reverses are not shown in FIG. 5. Valve 42 is used for the control of the drawing apparatus in the upward-moving stage 37. In this case, the pressure spaces 47 are connected with an oil drain 43.

Figure 5A:
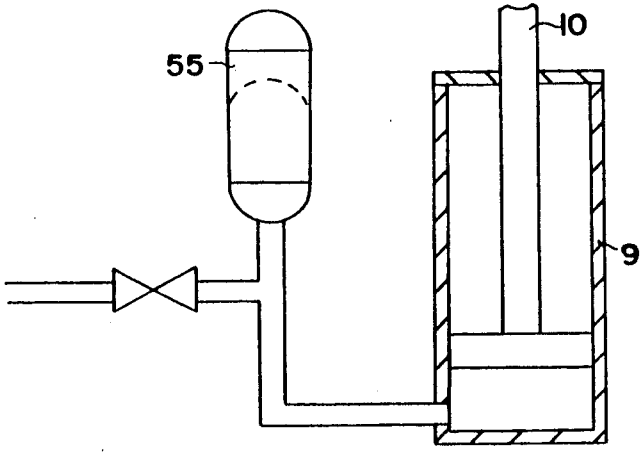
FIG. 5*a* schematically depicts operation of a drawing cylinder.

One of the drawing cylinders is illustrated schematically in FIG. 5*a*. The pressure space of the drawing cylinder 9 is reduced during the upward movement of the slide (curve 31) in FIG. 4, and the air is displaced into a reservoir (55 in FIG. 5*a*). The drawing cylinders have *no* hydraulic connection to the other cylinders 11, 14. These drawing cylinders 9 are arranged on the common plate or FIG. 8. After the down-stroke lowering of the slide (curve 31), these cylinders 9 try to move the console 5 upward as a result of the reservoir pressure in 55. These pistons 10 of the drawing cylinders 9, by way of the console 5 and clamping bolts 13, are connected with the bridge 12 so that, during an upward movement of the drawing cylinder pistons, under pressure from the reservoir 55, drawing 5*a*, the spindles 22 in FIG. 3 are also moved in the upward direction.

The spindles 22 come to rest against the piston 15 in the locking cylinders 14 after the bridge altogether has moved upward by the gap (48 in FIG. 3).

Drawing FIGS. 6*a*, 6*b*, 6*c* and 6*d* depict the operation of a press constructed according to the invention. These Figures show a slide 50 with a top part 51 of the tool, a bottom part 52 (corresponding to pressure cheek 3 described above) of the tool—which as a rule is an interior molding part of the bottom part of the tool which can be lowered with the drawing device 2 and the segments 4 in FIG. 1—as well as a blank 53 and a hold-down device 54.

Figure 6D:
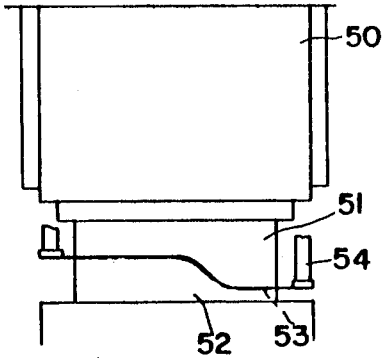
FIGS. 6*a* to 6*d* schematically depict the relative position of a drawing press slide and support during various stages of operation of the drawing press of FIG. 1–5.
Figure 6C:
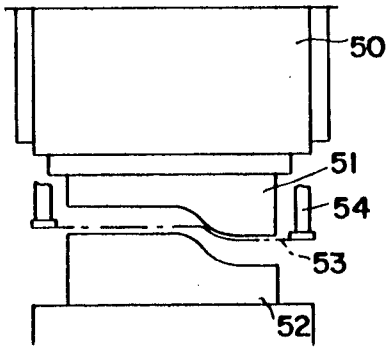

For these explanations, reference is also made to FIG. 4. FIG. 6*a* shows a point in time of the slide movement at which the slide 50 is still moving downward by itself. This is shown in FIG. 4 above the curve part 34. The drawing device 2 in FIG. 1 with the blank 53 in FIG. 6*a* is still stationary in the starting position.

Figure 6B:
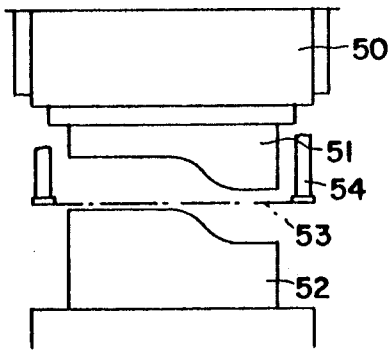
Figure 6A:
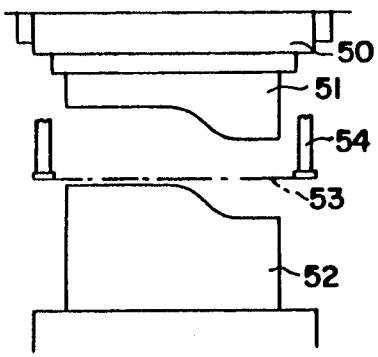

FIG. 6*b* shows the moment at which the pre-acceleration cylinder 17 in FIG. 3 lowers the bridge 12 and thus the drawing apparatus 2 with the bottom part 52 of the tool and the blank 53 and the hold-down device 54. This means that the slide 50 with the top part 51 of the tool runs behind the drawing device 2; see a, FIG. 4, timer period 34.

In FIG. 6*c* the slide 50 has caught up with the drawing device 2 with the bottom part 52 of the tool and the sheet 53. End of the time period 34, 34'—and with these parts 2, 52, 53, 54 moves into the lower position (lower dead center 35), shown in Drawing 6.

Figure 7:
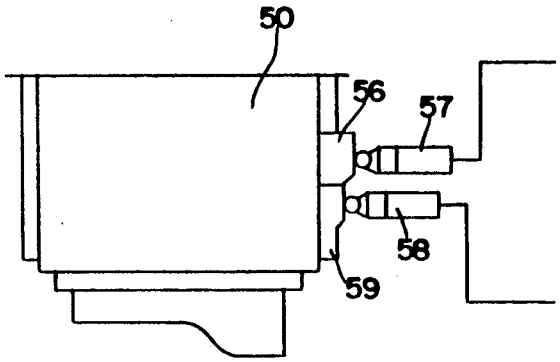
FIG. 7 schematically depicts a slide actuated switch assembly for controlling the locking cylinders of the press of FIGS. 1–6.

FIG. 7 shows the slide 50 with a switching cam 56, a switching cam 59, and the two switches 57, 58. Switch 57 determines the start of the stop stage 36 in FIG. 4. In the drawing stage valves 38/39 are open; valve 42 is shut and pressure medium (oil) is flowing into the pressure spaces 47. Upon reaching the Lower Dead Center position, switch 57 shuts valve 38 and valve 39 is still open so that the pressure in 47 prevents the running-up of 2. At the end of the stop stage 36, switch 58 shuts valve 39 and opens up valve 40 for the controlled running-up.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A drawing apparatus in a drawing stage of a press, comprising:

a pressure cheek for holding a metal sheet during a drawing operation;

separately adjustable pressure cylinders which, by way of the pressure cheek, act upon metal-sheet holders in tools, and locking cylinders for a controlled raising of the metal-sheet holder after the drawing operation, means for interrupting the controlled raising of the metal-sheet holder at a preselected position and for resuming the controlled raising of the metal-sheet holder after a predetermined time delay, wherein the pressure cheek is divided into segments which individually or jointly can be placed against the metal-sheet holder or holders, wherein respective ones of said pressure cylinders are associated with at least each of the corner areas of each of the segments, said pressure cylinders being fixed in relation to the press, wherein a plurality of piston rods are actuated by said pressure cylinders and are rigidly connected with one another by way of a liftable and lowerable console which all pressure rods have in common, and wherein at least one locking cylinder fixed to a frame of said press is applied to the console, said locking cylinder having a locking pressure space adapted to be selectively connected with a pressure source or with an oil drain by means of valves as a function of a slide movement of a press slide;

wherein said pressure cylinders comprise a plurality of drawing cylinders, said drawing cylinders and the locking cylinder being fixedly disposed on a cylinder bridge fixed to the press, wherein the console is arranged below the segments and is adapted to be lifted and lowered together with them, wherein the drawing cylinders are coupled by way of the pressure rods, further comprising: a lift bridge below the cylinder bridge which, can be lifted and lowered by means of clamping bolts, with the segments and the console, and a spindle which is rotatably disposed in a threaded bush fastened in the lift bridge and which can be adjusted by an adjusting device, for the unscrewing from the lift bridge or the screwing into it, for a stop at the cylinder bridge.

2. A drawing apparatus according to claim 1, wherein a pre-acceleration pressure cylinder is adapted for the pre-acceleration of the pressure cheek, the console, and the lift bridge part in a drawing direction, said spindle being placeable from below against the piston or the piston rod of the pressure pre-acceleration cylinder.

3. A drawing apparatus according to claim 2, wherein said pressure cylinders comprise a plurality of drawing cylinders, said drawing cylinders and said locking cylinders being fixedly disposed on a cylinder bridge fixed to the press, said console being arranged below the segments, and being adapted to lifted and lowered together with the segments, said drawing cylinders being linked by way of pressure rods, a lift bridge below the cylinder bridge which, by means of clamping bolts, can be lifted and lowered with the segments and the console, a first spindle which, in a threaded bush fastened in the lift bridge, by means of adjusting devices, can be unscrewed from the lift bridge and can be screwed into it, for a stop at the cylinder bridge, and a second spindle for each locking cylinder which, in a threaded bush fastened in the lift bridge, by means of adjusting devices, can be unscrewed from the lift bridge and can be screwed into it and can be brought into an operative connection from below with the piston of the pre-acceleration pressure cylinder.

* * * * *